US005129101A

United States Patent [19]

Douglas

[11] Patent Number: 5,129,101

[45] Date of Patent: Jul. 14, 1992

[54] IMPACT DISTRIBUTING PADS

[75] Inventor: Rogers Douglas, Houston, Tex.

[73] Assignee: Douglas Protective Equipment, Inc., Houston, Tex.

[21] Appl. No.: 652,153

[22] Filed: Feb. 7, 1991

[51] Int. Cl.[5] ..... A41D 13/00

[52] U.S. Cl. ..... 2/2; 2/45; 2/268

[58] Field of Search ..... 2/2, 45, 44, 92, 267, 2/DIG. 6, 268

[56] References Cited

U.S. PATENT DOCUMENTS

| | | | |
|---|---|---|---|
| 1,685,825 | 10/1978 | Mullins | 2/2 |
| 2,013,794 | 9/1935 | Taylor | 2/2 |
| 3,867,726 | 2/1975 | Owl et al. | 2/2 |
| 4,507,801 | 4/1985 | Kavanagh | 2/2 |
| 4,547,905 | 10/1985 | LaPorta, Jr. | 2/2 |
| 4,554,681 | 11/1985 | Kirkland | 2/2 |
| 4,590,622 | 5/1986 | Wolfe et al. | 2/DIG. 6 |
| 4,610,034 | 9/1986 | Johnson | 2/2 |
| 4,872,216 | 10/1989 | Wingo, Jr. | 2/2 |
| 4,982,447 | 1/1991 | Henson | 2/2 |

*Primary Examiner*—Werner H. Schroeder
*Assistant Examiner*—Amy B. Vanatta
*Attorney, Agent, or Firm*—Baker & McKenzie

[57] ABSTRACT

A shoulder pad which has auxiliary pads designed to conform to the shape of the wearer's shoulder. In one embodiment of the invention, a hook-and-loop fastening strap is used to enable a series of wedge-like pads to be moved to various positions on the inside of the shoulder pad. The series of auxiliary pads may be a group of three individual pads, each pad being independently positionable, or the auxiliary pads may be a group of hingedly connected pads positionable as a unit. To allow the auxiliary pads to be positioned at various locations, the shoulder area of the main cushion of the shoulder pad is equipped with a hook-and-loop fabric. The moveable auxiliary pads can be placed at any location on the fabric. The auxiliary pads of the present invention distribute impact forces in such a way as to reduce the chance of sustaining injury.

12 Claims, 2 Drawing Sheets

IMPACT DISTRIBUTING PADS

BACKGROUND AND SUMMARY OF THE INVENTION

The present invention relates to padding devices and, in particular, to the interior padding or cushions of pads, such as football shoulder pads.

Shoulder pads for contact sports such as football and hockey are generally constructed of a hard outer shell of thermoformed plastic. There are usually three hard plastic components for each shoulder, a main arch covering the chest and back extending over an inner part of the shoulder near the trapezius muscle, a smaller cup covering the outer part of the shoulder, and an epaulet partially overlying and covering the main arch and the cup. Cushions are attached to the underside of the main arch and the cup. In most shoulder pads designs, the epaulet does not have a corresponding underlying cushion.

Depending upon the skeletal and muscular shape of the wearer, the shoulder pad may or may not closely fit the contours of the wearer. In cases where a player has highly developed trapezius muscles and neck muscles, the shoulder pad, and impact forces applied thereto, can come to bear at particular stress points near the wearer's neck. These stress points result from the fixed position of the cushions of the shoulder pad, and the absence of cushions designed to closely fit the shape of a human shoulder. In many cases, the trapezius muscle unfortunately experiences an inordinate amount of pounding. As a result, neck and shoulder soreness can result. While single fixed wedge-shaped pads have been used to displace pads upwardly away from the trapezius muscle, there is a need for broader support extending to the front and the rear of the shoulder area when raising pads away from the trapezius muscle. The single wedge pad does not follow the contour of the whole shoulder area of the wearer. Another problem with non-contoured cushions in a shoulder pad is the inability to distribute impact forces away from areas of a player's shoulder where a prior injury may have occurred. Without the ability to adjust the positions of the cushions of a shoulder pad, a minor injury can be aggravated. For example, the A-C joint (acromio-clavicular joint) is a highly complex part of the human skeletal system which can become separated or otherwise injured during sports such as football and hockey. Fixed pad systems are unable to take such injuries into account.

Therefore, it is an object of the present invention to provide a padding system for athletes which is capable of improved distribution of impact forces.

Another object of the present invention is to provide a padding system in which impact forces can be directed away from particular points on a wearer's body.

Yet another object of the present invention is to provide a padding system in which prior injuries of a wearer can be protected by strategic location of padding components.

These and other objects and advantages of the present invention are achieved with a shoulder pad in which auxiliary padding elements, preferably having a sloping or wedge-like form, can be attached and, in some cases, held in various positions on the interior of the shoulder pad. The auxiliary padding elements may be fixed to the main cushion, or may be equipped with a sheet of hook-and-loop fastening means, which are attachable to mating hook-and-loop fastening means carried by interior surfaces of the cushions of the shoulder pads. The auxiliary pads can be removed or relocated easily, and are held against slipping by relatively broad areas of hook-and-loop interengagement. A single wedge-like top auxiliary pad may be used, and its adjustment may be primarily lateral, i.e., toward or away from the tip of the shoulder. Alternatively, auxiliary front and rear pads may be used either with or without the top auxiliary pad. The front and rear auxiliary pads are also wedge-like to account for the generally outwardly tapering slope of the human shoulder area.

The objects and advantages of the present invention will be better understood by reading the following specification with the accompanying drawings.

DETAILED DESCRIPTION OF THE INVENTION

Figure 1:
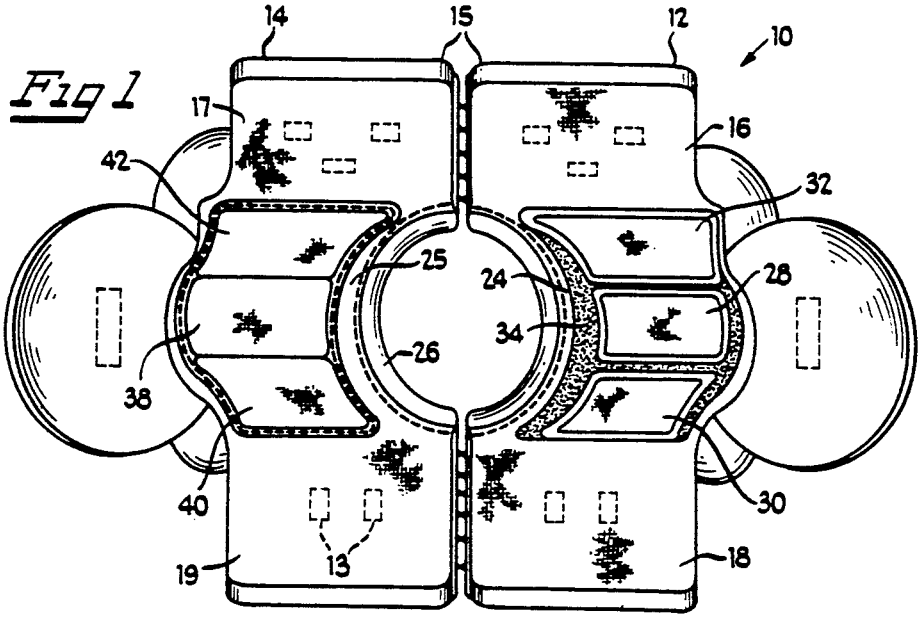
FIG. 1 is a bottom plan View of a shoulder pad of the present invention, showing two variations thereof.
Figure 2:
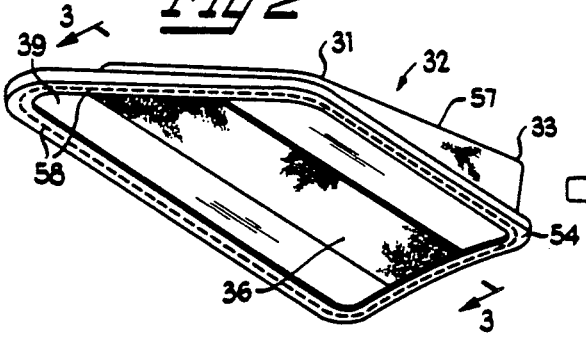
FIG. 2 is a perspective view of a rear auxiliary pad of the present invention.
Figure 3:
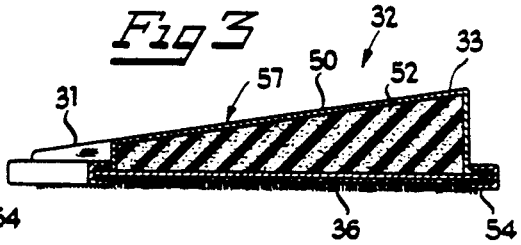
FIG. 3 is a sectional view taken along lines 3—3 of FIG. 2.
Figure 4:
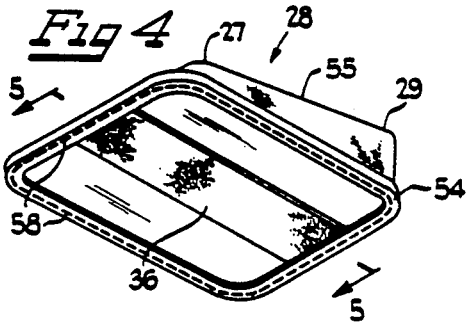
FIG. 4 is a perspective view of a top auxiliary pad of the present invention.

FIG. 1 shows a bottom plan view of a shoulder pad 10, which includes a main cushion 15 comprised of right and left portions 12 and 14 respectively. Chest cushions 18 and 19 are adjacent to corresponding shoulder areas or top portions 24 and 25 of the main cushion 15. The top portions 24 and 25 are, in turn, adjacent to right and left rear cushions 16 and 17. The main cushion 15 is attached to a shell 11 (not shown in FIG. 1 but shown in FIG. 9) by fastening means 13. The back, top, and chest cushions which comprise the right and left portions 12 and 14 of the main cushion 15 are each preferably formed of two pieces of fabric encapsulating a foam core.

The shoulder area 24 of the main cushion 15 is equipped with a sheet of hook-and-loop fastening fabric 34. Mating hook-and-loop fastening fabric 36 is disposed on one side of each of the individual auxiliary pads 28, 30 and 32. The hook-and-loop fastening fabric 34 is firmly attached, preferably by both stitching and adhesive, to the shoulder area 24 of the right portion 12 of the main cushion 15. The hook-and-loop straps 36 on the auxiliary pads enable the pads to be positioned at various locations on the hook-and-loop fabric 34.

The left portion 14 of the main cushion 15 includes a set of three auxiliary cushions 38, 40 and 42, which are shaped similar to the auxiliary pads shown in the FIGS. 2 through 7, but which are firmly attached to one another and to the shoulder area 25 by stitching near the collar 26 and by stitching at the outer periphery of the shoulder area 25. Clearly, both sides of the pad could be the same, i.e. both right and left portions 12 and 14 could have fixed auxiliary pads such as pads 38, 40 and 42, or both sides could have moveable auxiliary pads, like pads 28, 30 and 32.

In most cases, the auxiliary pads of the present invention will be sloped to accommodate the naturally outwardly and downwardly tapering form of the human shoulder. The tapering of the auxiliary pad 32 is clearly shown in FIG. 3. A thick section 33 and a thin section 31 are at opposite ends of the auxiliary pad 32 with a sloping surface 57 extending between the thick section 33 and the thin section 31. The end of the pad 32 having the thin section 31 come to a point 39 to increase the area of coverage of the wearer's back. The auxiliary pad 32 is preferably formed of a urethane coated nylon fabric 50 which is heat bonded to a foam core 52. The edges of the fabric 50 are enclosed within an edge cover 54 stitched to the fabric 50 by stitching 58. The stitching 58 assists in the retention of the hook-and-loop strap 36. However, additional adhesive is preferably utilized to firmly affix the hook-and-loop straps 36 to the fabric 50.

Figure 5:
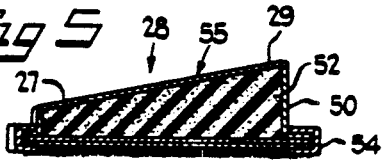
FIG. 5 is a sectional view taken along lines 5—5 of FIG. 4.
Figure 6:
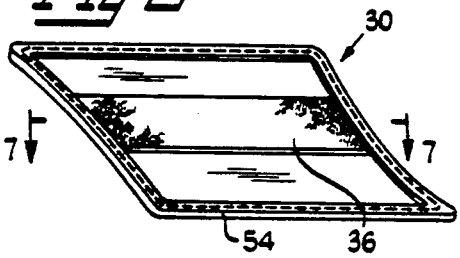
FIG. 6 is a top plan view of a front auxiliary pad of the present invention.

FIGS. 5 and 6 show auxiliary pad 28 which abuts and protects the top of a wearer's shoulder. The auxiliary pad 28 is sloped in a manner similar to the pad 32, i.e. a thick section 29 and a thin section 27 are at generally opposite ends of the pad, and a sloping surface 55 extends therebetween. The shope of the pad 28 compensates to the downwardly sloping top of the human shoulder.

Figure 7:
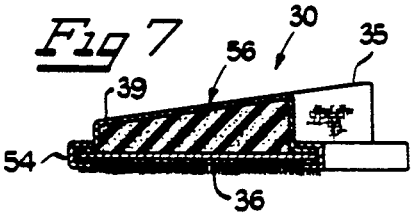
FIG. 7 is a sectional view taken along line 7—7 of FIG. 6.

FIGS. 6 and 7 show the front auxiliary pad 30, which has a profile generally resembling a slanted parallelogram. The shape of the front auxiliary pad 30 allows maximum protection of the front portion of the wearer's shoulder, while allowing maximum freedom of movement without interference from the pad. As with pads 28 and 32, the pad 30 is generally sloped. A thick section 35 and a thin section 31 are joined by a sloping surface 56.

Figure 8:
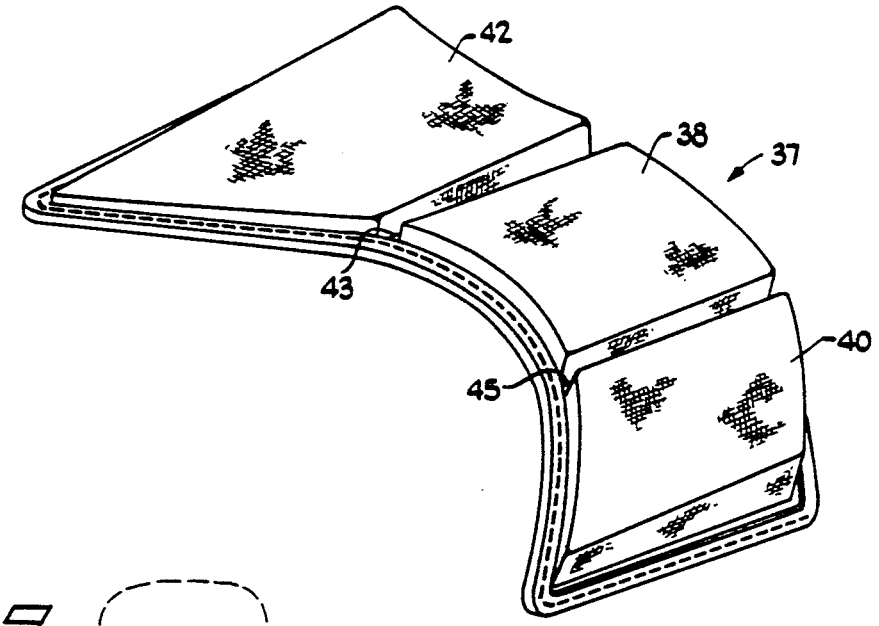
FIG. 8 is a perspective view of a combination auxiliary pad of the present invention.
Figure 9:
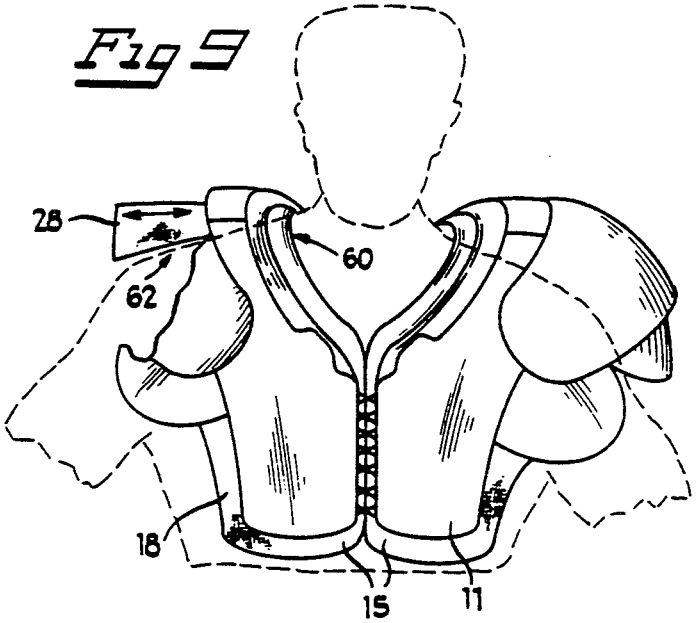
FIG. 9 is an elevational view in partial section showing an auxiliary pad of the present invention.
Figure 10:
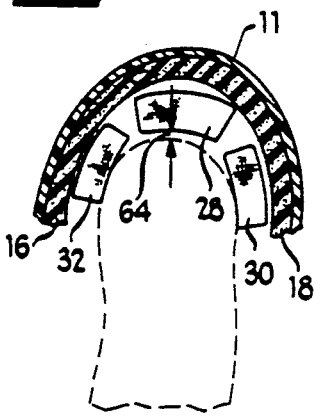
FIG. 10 is a sectional view taken along line 10—10 of FIG. 9 showing the present invention.

FIG. 8 shows an alternative embodiment of the present invention in which a front, top and rear auxiliary pad 40, 38 and 42, respectively, are joined together to form a three-part auxiliary pad 37. The three pads which make up the pad 37 are hingedly connected by two stitched joints 43 and 45, which allow the pads 40 and 42 to reach downwardly and pull at least partially forwardly and rearwardly to protect the front and rear portions of the wearer's shoulder, while the pad 38 protects the top thereof. The three-part auxiliary pad 37 is equipped with hook-and-loop straps, similar to the straps on the auxiliary pads shown in FIGS. 2 through 7. The three-part auxiliary pad 37 can be adjusted along a hook-and-loop fastening fabric 34 as shown in FIG. 1. Such adjustment is preferably in a direction radially inward and outward from the central neck opening of the shoulder pad. As shown in FIGS. 9 and 10, movement of the auxiliary pad 28 allows for raising and lowering of the shoulder pad relatively to the area 60 of the trapezius muscle of the wearer. Transfer of forces away from the area 60 of the trapezius muscle to the broader area 62 of the top of the shoulder provides for better dispersion and less concentration of impact forces encountered by the wearer. As a result, it is less likely that damage to the brachial plexus nerves will occur.

FIG. 10 shows that by individual adjustment of the pads, stress can be distributed away from a particular area of a wearer's shoulder. For example, by moving auxiliary pads 30 and 32 inward toward the wearer's neck, and by moving the top auxiliary pad 28 radially outward away from the wearer's neck, a gap 60 can be formed on the top of the wearer's shoulder to avoid transferring impact to this location. Forces applied to the top of the shell 11 will, at least initially, be transferred to the front and rear of the shoulder by pads 30 and 32.

While a specific embodiment of the invention has been shown and described, it will be apparent to those skilled in the art that numerous alternatives, modifications, and variations of the embodiment shown can be made without departing from the spirit and scope of the appended claims.

I claim:

1. A padding system for distributing impact to a wearer's body comprising an outer shell of generally rigid material, a main cushion layer generally forming to said shell, auxiliary padding means adjacent to said main cushion, said auxiliary padding means including a plurality of generally wedge-like pad components, said auxiliary padding means being in a generally arcuate array so as to face at least partially forward and rearward, at least one of said pad components being tapered such that one end thereof is thicker than another end thereof.

2. A padding system in accordance with claim 1 wherein:

said system includes at least two pad components, a first one conforming to rear portions of a wearer's shoulder area, and a second one conforming to front portions of a wearer's shoulder area.

3. A padding system in accordance with claim 2 wherein:

said auxiliary padding means is fixed into position adjacent to said main cushion.

4. A padding system in accordance with claim 3 wherein:

said auxiliary padding means is sewn to said main cushion.

5. A padding system in accordance with claim 3 wherein:

said auxiliary padding means is held in place by hook-and-loop fastening means.

6. A padding system in accordance with claim 5 wherein:

said hook-and-loop fastening means are comprised of mating interengaging parts carried by said main cushion and said auxiliary padding means.

7. A padding system in accordance with claim 1 wherein:

each of said components has an inner end adjacent to the wearer's neck and an outer end near the wearer's arm, said pad components being tapered such that said inner end is thinner than said outer end.

8. A shoulder pad comprising a generally rigid outer shell and inner cushion means, said cushion means closely fitting within said shell, said cushion means including at least two adjustably positionable auxiliary cushions, each of said auxiliary cushions being capable of being fixed at a plurality of locations adjacent to said cushion means, whereby said shoulder pad can be made to distribute impact loads to and away from various positions on a wearer's body.

9. A shoulder pad in accordance with claim 8 wherein:

said inner cushion means has hook-and-loop fabric disposed on a portion of the inner surface thereof, and said auxiliary cushions are equipped with hook-and-loop fastening fabric attached thereto to facilitate quick, secure, and accurate positioning of said auxiliary cushions adjacent to said inner cushion means at a plurality of locations.

10. A shoulder pad in accordance with claim 9 wherein:

said auxiliary cushions include three individual auxiliary cushions, a first cushion for cushioning the top of a wearer's shoulder, a second cushion for cushioning the front of a wearer's shoulder, and a third cushion for cushioning the rear of a wearer's shoulder.

11. A shoulder in accordance with claim 10 wherein:

said individual auxiliary cushions are separate and separately positionable.

12. A shoulder pad in accordance with claim 10 wherein:

each of said individual auxiliary cushions is attached to at least one other auxiliary cushion to form a set, said second and third auxiliary cushions being hingedly connected to opposite sides of said first auxiliary cushion, said set being removable and positionable to a plurality of positions.

* * * * *